US006161526A

United States Patent [19]

Sakata et al.

[11] Patent Number: 6,161,526

[45] Date of Patent: Dec. 19, 2000

[54] SOLENOID VALVE FIXING STRUCTURE

[75] Inventors: Akira Sakata; Tatsuya Matsumoto, both of Tokyo, Japan

[73] Assignee: Mitsubishi Denki Kabushiki Kaisha, Tokyo, Japan

[21] Appl. No.: 09/292,401

[22] Filed: Apr. 15, 1999

[30] Foreign Application Priority Data

Nov. 24, 1998 [JP] Japan ..... 10-333055

[51] Int. Cl.[7] ..... F02M 33/04

[52] U.S. Cl. ..... 123/519; 123/520

[58] Field of Search ..... 123/516, 518, 123/519, 520

[56] References Cited

U.S. PATENT DOCUMENTS

| | | | |
|---|---|---|---|
| 5,794,599 | 8/1998 | Blumenstock | 123/520 |
| 5,806,500 | 9/1998 | Fargo et al. | 123/520 |
| 5,845,625 | 12/1998 | Kidokoro et al. | 123/520 |
| 5,850,819 | 12/1998 | Kunimitsu et al. | 123/520 |
| 5,873,352 | 2/1999 | Kidokoro et al. | 123/520 |
| 6,053,151 | 4/2000 | Cook et al. | 123/520 |

FOREIGN PATENT DOCUMENTS

| | | |
|---|---|---|
| 3-37368 | 2/1991 | Japan . |
| 5-73254 | 10/1993 | Japan . |
| 9-25855 | 1/1997 | Japan . |

*Primary Examiner*—Thomas N. Moulis

*Attorney, Agent, or Firm*—Sughrue, Mion, Zinn, Macpeak & Seas, PLLC

[57] ABSTRACT

The present invention relates to a solenoid valve fixing structure. In an apparatus for suppressing evaporated fuel gas emission, of the prior art, the solenoid valve is fixed to a frame of a vehicle independently from the fixing of a check valve or an air filter. Hence, there are drawbacks, for example, that the number of the fabrication elements is large, and the fabrication performance is small.

The present invention propose a solenoid valve fixing structure constructed as a module comprised of a solenoid valve, a check valve and an air filter. Namely a solenoid valve 10 and a check valve 8 are fixed onto a cover 3 of an air filter 1. The number of the fabrication elements can be reduced. The size of the apparatus can be made small, by using the module.

In an embodiment, a nipple (11a) of the solenoid valve (10) is inserted through an O-ring (13) into an insertion hole (3a) disposed in the cover (2), and the solenoid valve 10 is fixed to the cover (2) of the air filter (1) using bolts (14) arranged so that its longitudinal direction is perpendicular to the moving direction (12) of the plunger is the solenoid valve. Therefore, the fixing onto the cover (3) of the air filter is easy.

The noisy sound at the operation of the solenoid valve can be reduced.

8 Claims, 4 Drawing Sheets

FIG.4 (PRIOR.ART)
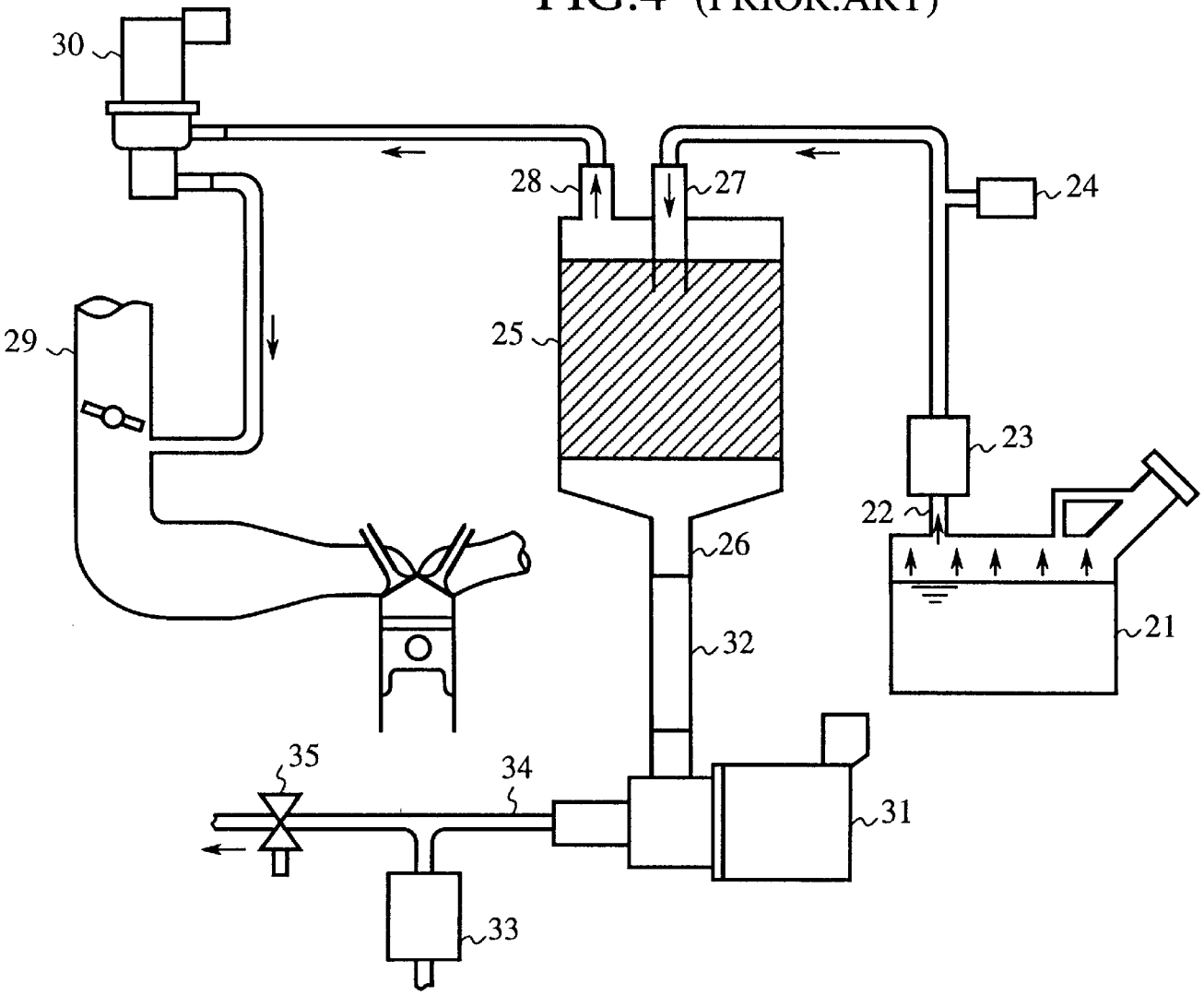

SOLENOID VALVE FIXING STRUCTURE

BACKGROUND OF THE INVENTION

1. Field of the Invention

The present invention relates to a solenoid valve fixing structure, more particularly, a solenoid valve fixing structure constructed as a module comprised of a solenoid valve, a check valve and an air filter. They are components of an apparatus for suppressing evaporated fuel gas emission, which protects the emission of evaporated fuel gas into the atmosphere. The evaporated fuel gas is a gas evaporated from a fuel tank of a vehicle, for example.

2. Description of the Prior Art

A system for reserving hydro-carbon gas using an activated carbon canister is well known, in which a hydro-carbon gas evaporated from the fuel in a fuel tank, due to engine heat or external heat, is temporally reserved in an activated carbon containing canister, and while the vehicle is running, the reserved gas is sent into the intake manifold of the engine of a vehicle so as to be burned out, for protecting the emission of the hydro-carbon gas into the atmosphere.

A representative apparatus for suppressing evaporated fuel gas emission in the prior art, in which hydro-carbon gas is reserved in an activated carbon canister is explained below, referring to FIG. 4, which is a schemtaic diagram of an apparatus for suppressing the evaporated fuel gas emission of the prior art.

Reference numeral 21 denotes a fuel tank, the fuel tank is connected with a separator 23 through a channel 22. The evaporated gas from the fuel tank is separated into a liquid component and a gas component in the separator 23. Reference numeral 24 denotes a pressure sensor for diagnosis, which detects pressure change for detecting leakage of the evaporated fuel gas while the vehicle is running. Reference numeral 25 denotes a canister containing activated carbon for reserving the evaporated fuel gas temporally. The canister 25 has an air introducing hole 26, an evaporated fuel gas introducing hole 27 and an outlet hole 28 of the reserved fuel gas, which is lead to an intake manifold 29 of the engine. The purge quantity of the evaporated fuel gas from the canister 25 to the intake manifold 29 is controlled by a purge valve 30.

A solenoid valve 31 controls the opening and closing of an air introducing hole 26 of the canister 26. Ordinarily, the solenoid valve 31 keeps an opening state so that the air introducing hole 26 is open to the atmosphere. This solenoid valve 31 is closed, only when the communication from the atmosphere shall be cut off at a diagnosis of the apparatus. The solenoid valve 31 is connected to the air introducing hole 26 through an air hose 32.

The solenoid valve 31 is connected with an air filter 33 and a check valve 35 through piping 34. The air filter 33 serves to clarify the air to be introduced into the solenoid valve. The check valve 35 opens when the pressure in the fuel tank increases, for example, during an oil feeding into the fuel tank. As a result, the increase of pressure in the fuel tank is suppressed, and the oil can be fed easily into the fuel tank 21.

The solenoid valve 31, the check valve 35 and the air filter 33 are independently fixed, for example, to a side frame of a vehicle, by means of bolts, for example. They are interconnected through piping 34.

The function of the apparatus for suppressing evaporated fuel gas emission of this prior art is explained below.

The gas component of the fuel evaporated from the fuel tank 21 is separated by the separator 23 as an evaporator fuel gas, and is reserved in the canister 25 temporally.

The air introducing hole 26 of the canister 25 is maintained to be open to the atmosphere by the solenoid valve 31, but is closed at a diagnosis of the apparatus. While it is closed, a measurement of the pressure is carried out by the pressure sensor 24, and a diagnosis whether a leakage of evaporated fuel gas according to a break down of piping, for example, is taking place or not is made.

While the vehicle is running, the evaporated gas reserved in the canister 25 is sucked by the negative pressure of the intake manifold 29 through an outlet hole 28 of the canister. The sucked fuel gas is sent to the engine of the vehicle to be burned out therein. Thus the emission of the hydro-carbon gas into the atmosphere is protected. The "negative pressure" is defined as "pressure lower than atmospheric pressure" in this specification and claims.

The apparatus for suppressing evaporated fuel gas emission in the prior art has drawbacks that the solenoid valve 31, the check valve 35 and the air filter 33 must be independently fixed, for example, to a side frame of a vehicle. Hence, many supplemental connecting elements, for example, bolts or piping are required, for their installation. This means that the number of fabrication elements as well as the number of steps for installing them are large, as a result, the fabrication performance is low.

Additionally, the piping 34 is the longer, the possibility of leakage of evaporated fuel gas is the higher, thus, the total reliability of the system becomes lower accordingly.

The piping 34 for communication with the atmosphere must have a larger diameter. Thus the solenoid valve 31, which opens and closes the piping 34, tends to generate noisy sound, when it operates. The reduction of the noisy sound was difficult.

An improvement of the connection between a solenoid valve and a canister of the prior art is disclosed in Japanese patent applications JP-A-6-73254 and JP-A-3-37368. And a module, in which a solenoid valve and air filter, etc, are fixed to a fixing bracket of a canister, which serves to fix the canister to the vehicle is disclosed in Japanese patent application JP-A-9-25855. However, they do not disclose a module comprised of a solenoid valve, a check valve and a canister, for the purpose of reducing the number of fabrication elements as well as to improve the fabrication performance, and to decrease the size of the apparatus.

SUMMARY OF THE INVENTION

An object of the present invention is to solve the aforementioned problem.

Another object is to propose a solenoid valve fixing structure constructed as a module of elements for communication with the atmosphere, for example, a solenoid valve, a check valve and an air filter, etc.

Another object is to propose a solenoid valve fixing structure constructed as a module, which can reduce the number of fabrication elements, improve the fabrication performance, and make small the size of the apparatus.

Another object is to propose a solenoid valve fixing structure, which can reduce the noisy sound at the operation of the solenoid valve.

The objects are attained by fixing a solenoid valve directly to the case of the air filter.

In an embodiment, the solenoid valve and a check valve is fixed to the case of the air filter.

In an embodiment, a nipple of the solenoid valve is inserted through an O-ring into an insertion hole disposed in the case of the air filter.

In an embodiment, the longitudinal direction of the solenoid valve fixed on the air filter is perpendicular to the moving direction of the plunger in the solenoid valve.

BRIEF DESCRIPTION OF THE DRAWINGS

FIG. 1 shows an A—A cross section of FIG. 2.

FIG. 4 is a schematic diagram of an apparatus for suppressing the evaporated fuel gas emission in the prior art.

DETAILED DESCRIPTION OF THE PREFERRED EMBODIMENT

Figure 1:
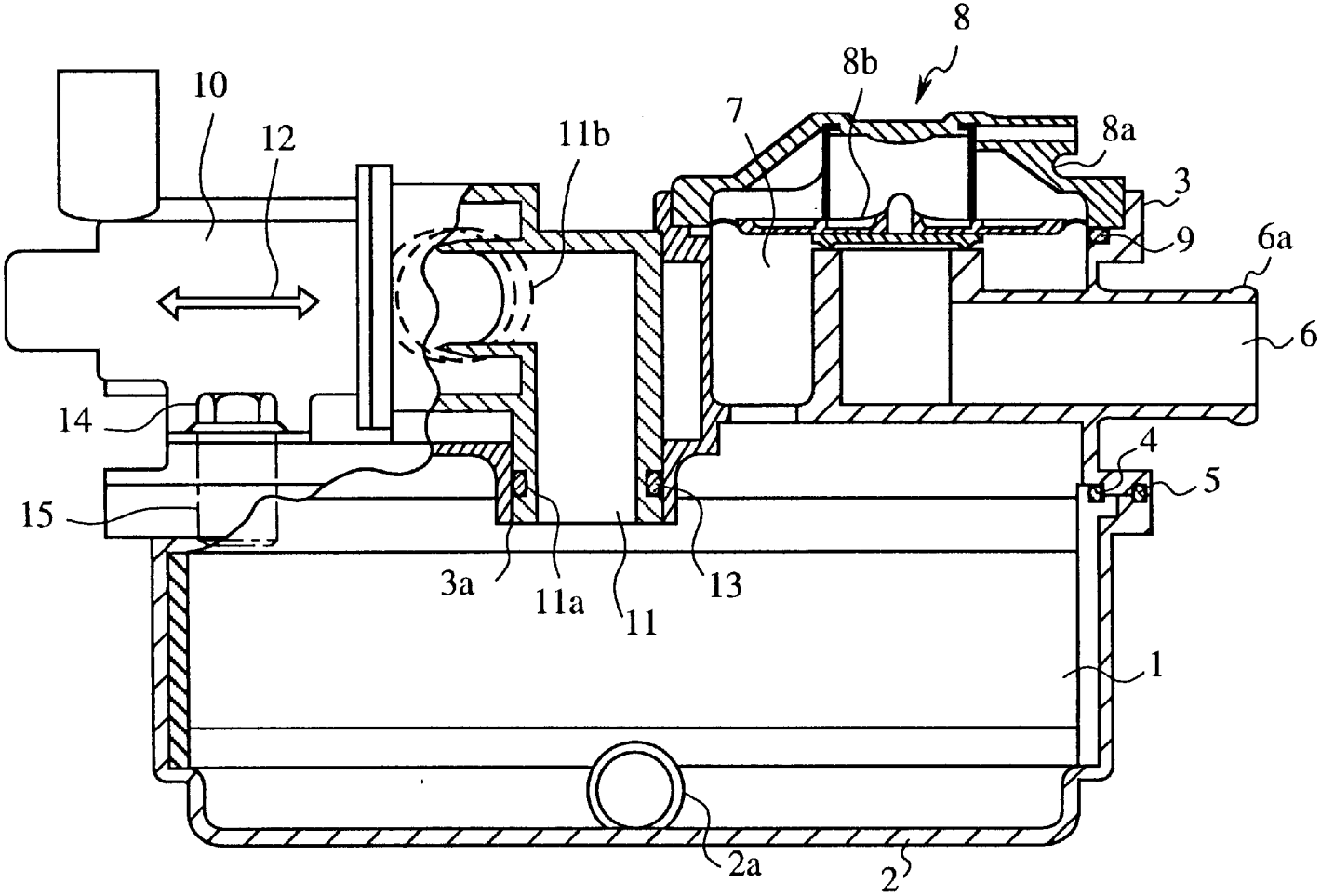
FIG. 1 is a cross sectional front view of a module comprised of a solenoid valve, a check valve and an air filter according to the first embodiment of the present invention.
Figure 2:
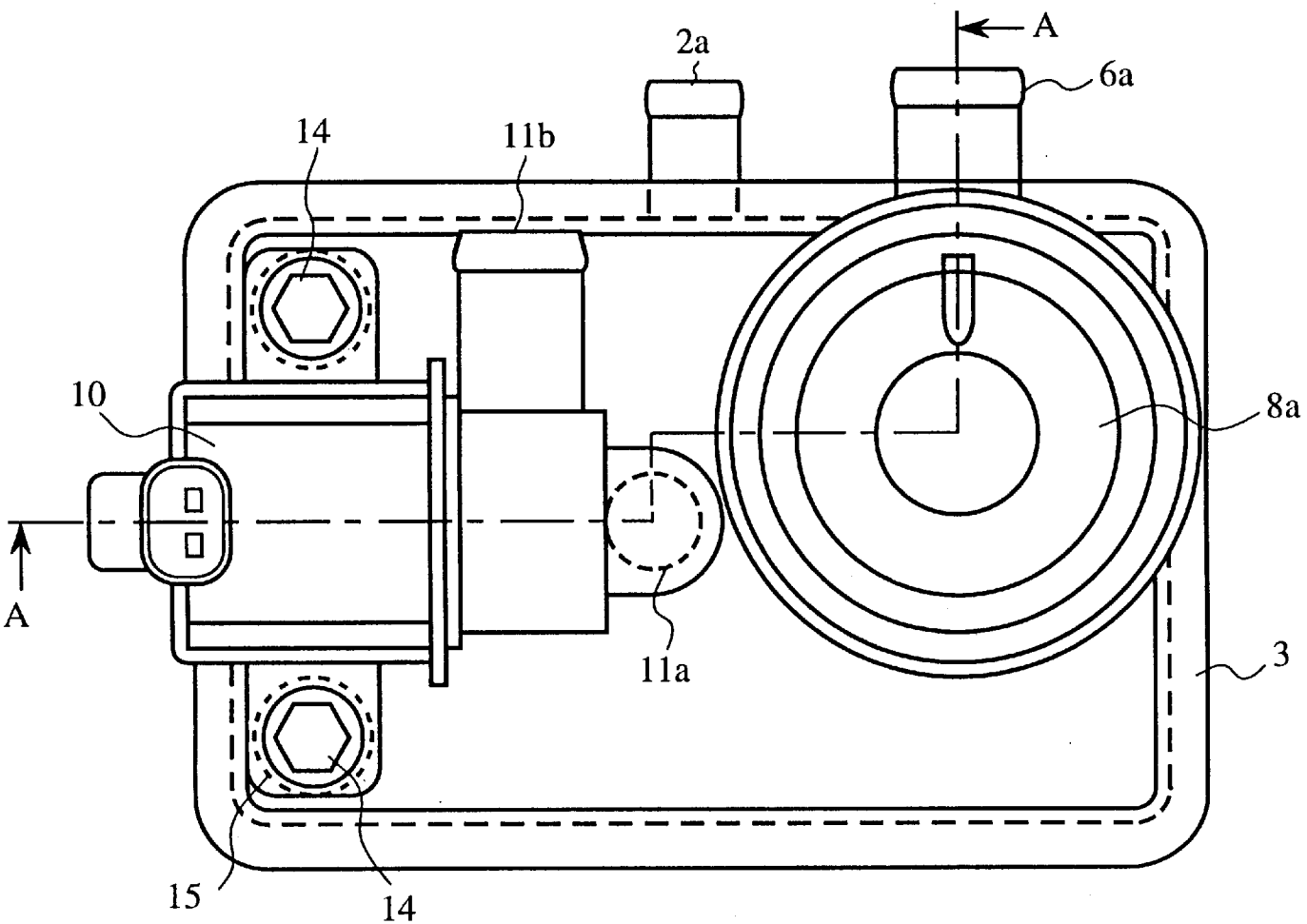
FIG. 2 is a plan view of the module comprised of a solenoid valve, a check valve and an air filter shown in FIG. 1.
Figure 3:
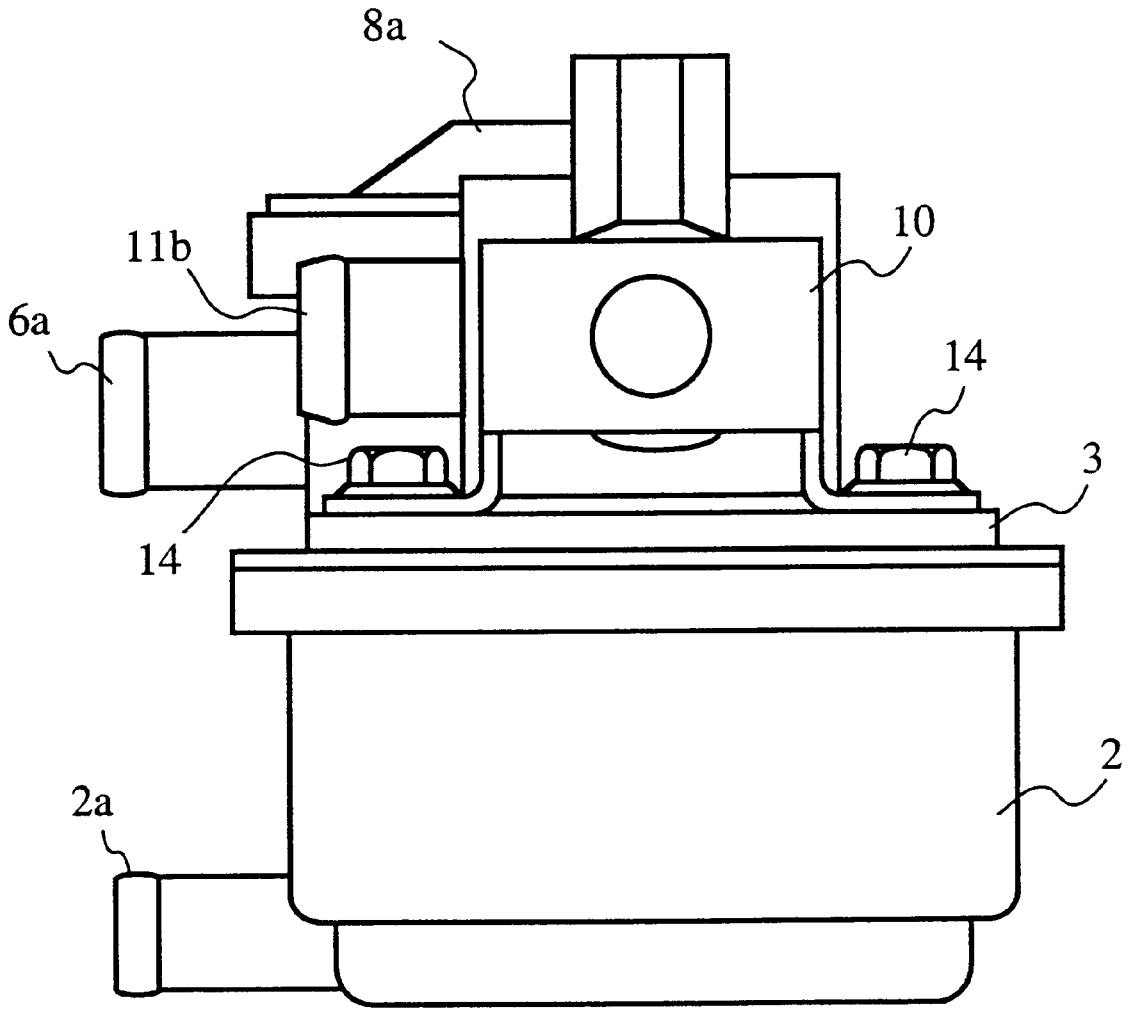
FIG. 3 is a side view of the module comprised of a solenoid valve, a check valve and an air filter shown in FIG. 1.

EMBODIMENT:

The structure of a module comprised of a solenoid valve, a check valve and an air filter according to the first embodiment of the present invention is explained below, referring to FIGS. 1–3.

Reference numeral 1 denotes an air filter, received in a synthetic resin case 2. The air filter 1 has a nipple 2*a* for communicating the inside and outside of the case, the nipple 2*a* acts as an inlet and an outlet of the air. The case 2 has a cover 3. There are O-rings 4, 5 between them. The cover 3 has channels 6, 7 for communicating the inside and the outside of the cover 3. The channels 6, 7 for communicating the inside and the outside When the pressure in the fuel tank (not shown) increases during an oil feeding, the check valve 8 opens to communicate the channels 6, 7, so as to release the inside pressure to the atmosphere.

Reference numeral 3*a* denotes a hole for receiving a nipple 11*a* of a solenoid valve 10 through an O-ring. The channel 6 ends with a nipple 6*a*. The check valve 8 comprises a diaphragm 8*b* disposed in the valve cover 8*a*, which is tightly fixed to the cover 3 through an O-ring 9. The check valve 8 serves to open and close the communication between the channels 6, 7.

The solenoid valve 10 has a channel 11 communicating with a nipple 11*a*. In a normal state, the solenoid valve 10 is opened, and introduces the air from the nipple 2*a* through the nipple 11*a*. The introduced air is sent to a canister (not shown) through a nipple 11*b*. The canister is connected with a nipple 11*b* by piping. The arrow 12 indicates the moving direction of the plunger in the solenoid valve.

The nipple 11*a* has an O-ring 13 set in a groove disposed on the peripheral of the nipple 11*a*. The solenoid valve 10 is fixed to the cover 3 by bolts 14, which engage with nuts 15 disposed at the inner side of the cover 3. The nuts 15 are arranged at the corner portions of the cover 3, as shown in FIG. 2. The longitudinal direction of the bolt 14 is perpendicular to the moving direction 12 of the plunger in the solenoid valve 10, as shown in FIG. 1. This configuration of the bolts 14 reinforces the structure of the module, and protects the amplification, due to a resonance in the hollow case 2, of sound at the operation of the solenoid.

The essential structures of the fuel tank, canister, intake manifold, which are not shown in the figures, are the same as the prior art, therefore, their detailed explanation is omitted here.

The evaporated gas from the fuel tank (not shown) is reserved temporally in a canister (not shown). In an ordinary state, an air introducing hole of the canister is kept open to the atmosphere by the solenoid valve 10. This air introducing hole is closed, only when the communication from the atmosphere shall be cut off at a diagnosis of the apparatus. At the diagnosis, it is inspected using a pressure sensor (not shown), for example, whether a leakage of evaporated gas from the fuel tank, due to a break down of piping, for example, is occurred or not.

The sound caused by the operation of the solenoid valve 10 hardly resonates in the hollow case 2, because the solenoid valve is arranged on the cover and fixed by the bolts 14 and the nuts 15, as explained. Moreover, the oscillation caused by the operation of the solenoid valve 10 is absorbed partially by the O-ring 13. Therefore, the O-ring 13 contributes not only to protect the leakage of the gas, but also to reduce the sound level.

Additionally, the O-ring protects the propagation of mechanical oscillation generated in the solenoid valve 10 to the case 2. Thus, the generation of noisy sound can be suppressed.

While the vehicle is running, the evaporated fuel gas reserved in the canister 25 is sucked by negative pressure of the intake manifold and is sent into the engine so as to be burned out. Hence, the emission of hydro-carbon into the atmosphere is avoided.

The air introduced through the nipple 2*a* is clarified by the air filter 1.

When the pressure in the fuel tank (not shown) increases during oil feeding, for example, the check valve opens so that the channels 6 and 7 communicates to each other. As a result, the inner pressure is released to the atmosphere. Thus, the pressure in the fuel tank is suppressed under a predetermined pressure value.

Advantages of the module comprised of a solenoid valve 10, a check valve 8 and an air filter 1 according to the first embodiment of the present invention are that the number of fabrication elements can be reduced and that the fabrication performance can be improved, as explained.

Another advantage is that the size of the apparatus can be made smaller.

Another advantage is that the total reliability of the system can be improved. Because these elements can be interconnected without using supplemental piping, as a result, the possibility of leakage of evaporated fuel gas can be reduced.

Another advantage is that noisy sound during the operation of the solenoid valve 10 can be reduced.

Another advantage is that the sound generated in the solenoid valve 10 hardly propagates to the case 2 through the nipple 11*a*, because the nipple 11*a* in the first embodiment is folded or bent.

By the way, the module according to the first embodiment, both the solenoid valve 10 and the check valve 8 are fixed to the cover 3 of the air filter 1. However, the scope of the invention is to limited to such structure. Namely, there is a case that only the solenoid valve 10 is fixed to the cover by an aforementioned means. Even in such a case, the piping between the solenoid valve 10 and the air filter 1 can be omitted. Also, the noisy sound at the operation of the solenoid valve can be reduced.

Another advantage of the present invention is that when the nipple of the solenoid valve has an O-ring around it, it is easy to insert the nipple into the insertion hole, disposed in the case of the air filter, namely, the installation of the solenoid valve onto the case of the air filter is easy, additionally the oscillation at the operation of the solenoid valve can be partially adsorbed by the O-ring, therefore the noisy sound at the operation of the solenoid valve can be reduced.

Another advantage of the present invention is that the noisy sound at the operation of the solenoid valve can be reduced, when the solenoid valve (10) is arranged so that the longitudinal direction of the solenoid valve is perpendicular to the moving direction (12) of the plunger of the solenoid valve (10).

What is claimed is:

1. A solenoid valve fixing structure constructed as a module comprised of a solenoid valve for opening and closing a channel communicating between a canister and the atmosphere, a check valve, which can release the pressure in the channel to the atmospheric pressure, and an air filter for clarifying the air to be introduced to the canister, wherein the solenoid valve is fixed to the case of the air filter.

2. A solenoid valve fixing structure constructed as a module according to claim 1, wherein the check valve is fixed to the case of the air filter.

3. A solenoid valve fixing structure constructed as a module according to claim 1, wherein a nipple of the solenoid valve is inserted into an insertion hole, which is disposed in the case of the air filter, through an O-ring.

4. A solenoid valve fixing structure constructed as a module according to claim 3, wherein the insertion hole is disposed in the cover of the case.

5. A solenoid valve fixing structure constructed as a module according to claim 3, wherein the solenoid valve is fixed to the cover of the air filter using bolts arranged so that its longitudinal direction is perpendicular to the moving direction of the plunger in the solenoid valve.

6. A solenoid valve fixing structure constructed as a module according to claim 3, wherein the solenoid valve is arranged so that the longitudinal direction of the portion, where the solenoid valve is fixed to the air filter, is perpendicular to the moving direction of the plunger of the solenoid valve.

7. A solenoid valve fixing structure constructed as a module according to claim 3, wherein the nipple of the solenoid valve connecting with the air filter is bent.

8. A solenoid valve fixing structure constructed as a module according to claim 3, wherein the module constitutes a part of an apparatus for suppressing evaporated fuel gas emission.

* * * * *